US010998642B1

(12) United States Patent
McCandless et al.

(10) Patent No.: US 10,998,642 B1
(45) **Date of Patent: *May 4, 2021**

(54) DUAL POLARIZATION PATCH ANTENNA SYSTEM

(71) Applicant: Pivotal Commware, Inc., Kirkland, WA (US)

(72) Inventors: Jay Howard McCandless, Alpine, CA (US); Eric James Black, Bothell, WA (US); Isaac Ron Bekker, Los Angeles, CA (US)

(73) Assignee: Pivotal Commware, Inc., Kirkland, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/983,927

(22) Filed: Aug. 3, 2020

Related U.S. Application Data

(63) Continuation of application No. 16/734,195, filed on Jan. 3, 2020, now Pat. No. 10,734,736.

(51) Int. Cl.
*H01Q 9/04* (2006.01)
*H01Q 21/24* (2006.01)
(Continued)

(52) U.S. Cl.
CPC ..... *H01Q 21/245* (2013.01); *H01Q 1/38* (2013.01); *H01Q 9/0435* (2013.01); *H01Q 21/065* (2013.01); *H01Q 25/001* (2013.01)

(58) Field of Classification Search
CPC ..... H01Q 9/04; H01Q 9/0407; H01Q 9/045; H01Q 9/0478
See application file for complete search history.

(56) References Cited

U.S. PATENT DOCUMENTS 2,131,108 A 9/1938 Lindenblad
6,133,880 A 10/2000 Grangeat et al.
(Continued)

FOREIGN PATENT DOCUMENTS

CN 106797074 A 5/2017
JP 61-1102 A 1/1986
(Continued)

OTHER PUBLICATIONS

Office Communication for U.S. Appl. No. 15/925,612, dated Jun. 15, 2018, pp. 1-9.
(Continued)

*Primary Examiner* — Blane J Jackson
(74) *Attorney, Agent, or Firm* — John W. Branch; Branch Partners PLLC

(57) ABSTRACT

A switchable dual polarization patch antenna with improved cross polarization isolation to concurrently radiate horizontally polarized signals and vertically polarized signals. A planar conductor is arranged with a first terminal and a second terminal that are vertically spaced on a portion of the planar conductor to radiate a component of a vertically polarized signal with zero degrees of phase shift from one of the two terminals and radiate another component of the vertically polarized signal having a 180 degrees of phase shift from the other of the two terminals. A hybrid coupler can provide the 180 degrees of phase shift. A horizontally polarized signal is radiated from a third terminal that is horizontally spaced on another portion of the planar conductor and coupled to a horizontally polarized signal source. The direction of the 180 phase shift for the first and second components of the vertically polarized signal may be selected. Also, a direction for a phase shift for the horizontally polarized signal may be selectable.

20 Claims, 10 Drawing Sheets

(51) Int. Cl.

| | |
|---|---|
| ***H01Q 21/06*** | (2006.01) |
| ***H01Q 1/38*** | (2006.01) |
| ***H01Q 25/00*** | (2006.01) |

(56) References Cited

U.S. PATENT DOCUMENTS

| | | | | |
|---|---|---|---|---|
| 6,150,987 | A | 11/2000 | Sole et al. | |
| 7,084,815 | B2 * | 8/2006 | Phillips | H01Q 9/0414 343/700 MS |
| 7,205,949 | B2 | 4/2007 | Turner | |
| 9,356,356 | B2 | 5/2016 | Chang et al. | |
| 9,385,435 | B2 | 7/2016 | Bily et al. | |
| 9,450,310 | B2 | 9/2016 | Bily et al. | |
| 9,551,785 | B1 | 1/2017 | Geer | |
| 9,635,456 | B2 | 4/2017 | Fenichel | |
| 9,711,852 | B2 | 7/2017 | Chen et al. | |
| 9,806,414 | B2 | 10/2017 | Chen et al. | |
| 9,806,415 | B2 | 10/2017 | Chen et al. | |
| 9,806,416 | B2 | 10/2017 | Chen et al. | |
| 9,812,779 | B2 | 11/2017 | Chen et al. | |
| 10,033,109 | B1 | 7/2018 | Gummalla et al. | |
| 10,225,760 | B1 | 3/2019 | Black | |
| 10,313,894 | B1 | 6/2019 | Desclos et al. | |
| 10,468,767 | B1 * | 11/2019 | McCandless | H01Q 1/521 |
| 10,734,736 | B1 * | 8/2020 | McCandless | H01Q 25/001 |
| 2002/0196185 | A1 | 12/2002 | Bloy | |
| 2003/0025638 | A1 | 2/2003 | Apostolos | |
| 2005/0237265 | A1 | 10/2005 | Durham et al. | |
| 2007/0024514 | A1 | 2/2007 | Phillips et al. | |
| 2008/0181328 | A1 | 7/2008 | Harel et al. | |
| 2009/0207091 | A1 | 8/2009 | Anagnostou et al. | |
| 2010/0248659 | A1 | 9/2010 | Kawabata | |
| 2010/0302112 | A1 | 12/2010 | Lindenmeier et al. | |
| 2011/0070824 | A1 | 3/2011 | Braithwaite | |
| 2011/0199279 | A1 * | 8/2011 | Shen | H01Q 9/0435 343/857 |
| 2012/0194399 | A1 | 8/2012 | Bily et al. | |
| 2013/0069834 | A1 | 3/2013 | Duerksen | |
| 2013/0231066 | A1 | 9/2013 | Zander et al. | |
| 2014/0094217 | A1 | 4/2014 | Stafford | |
| 2014/0171811 | A1 | 6/2014 | Lin et al. | |
| 2014/0198684 | A1 | 7/2014 | Gravely et al. | |
| 2014/0266946 | A1 | 9/2014 | Bily et al. | |
| 2014/0293904 | A1 | 10/2014 | Dai et al. | |
| 2014/0308962 | A1 | 10/2014 | Zhang et al. | |
| 2015/0109178 | A1 | 4/2015 | Hyde et al. | |
| 2015/0109181 | A1 | 4/2015 | Hyde et al. | |
| 2015/0116153 | A1 | 4/2015 | Chen et al. | |
| 2015/0162658 | A1 | 6/2015 | Bowers et al. | |
| 2015/0222021 | A1 | 8/2015 | Stevenson et al. | |
| 2015/0229028 | A1 | 8/2015 | Bily et al. | |
| 2015/0276926 | A1 | 10/2015 | Bowers et al. | |
| 2015/0276928 | A1 | 10/2015 | Bowers et al. | |
| 2015/0288063 | A1 | 10/2015 | Johnson et al. | |
| 2015/0318618 | A1 | 11/2015 | Chen et al. | |
| 2015/0372389 | A1 | 12/2015 | Chen et al. | |
| 2016/0037508 | A1 | 2/2016 | Sun | |
| 2016/0079672 | A1 * | 3/2016 | Cerreno | H01Q 21/065 343/848 |
| 2016/0087334 | A1 | 3/2016 | Sayama et al. | |
| 2016/0149308 | A1 | 5/2016 | Chen et al. | |
| 2016/0149309 | A1 | 5/2016 | Chen et al. | |
| 2016/0149310 | A1 | 5/2016 | Chen et al. | |
| 2016/0164175 | A1 | 6/2016 | Chen et al. | |
| 2016/0174241 | A1 | 6/2016 | Ansari et al. | |
| 2016/0219539 | A1 | 7/2016 | Kim et al. | |
| 2016/0241367 | A1 | 8/2016 | Irmer et al. | |
| 2016/0269964 | A1 | 9/2016 | Murray | |
| 2016/0345221 | A1 | 11/2016 | Axmon et al. | |
| 2017/0118750 | A1 | 4/2017 | Kikuma et al. | |
| 2017/0127295 | A1 | 5/2017 | Back et al. | |
| 2017/0127296 | A1 | 5/2017 | Gustafsson et al. | |
| 2017/0127332 | A1 | 5/2017 | Axrnon et al. | |
| 2017/0155192 | A1 | 6/2017 | Black et al. | |
| 2017/0155193 | A1 | 6/2017 | Black et al. | |
| 2017/0187123 | A1 | 6/2017 | Black et al. | |
| 2017/0187426 | A1 | 6/2017 | Su et al. | |
| 2017/0238141 | A1 | 8/2017 | Lindoff et al. | |
| 2017/0339575 | A1 | 11/2017 | Kim et al. | |
| 2017/0367053 | A1 | 12/2017 | Noh et al. | |
| 2017/0373403 | A1 * | 12/2017 | Watson | H04L 5/14 |
| 2018/0027555 | A1 | 1/2018 | Kim et al. | |
| 2018/0066991 | A1 | 3/2018 | Mueller et al. | |
| 2018/0097286 | A1 | 4/2018 | Black et al. | |
| 2018/0219283 | A1 * | 8/2018 | Wilkins | H01Q 25/001 |
| 2018/0227035 | A1 | 8/2018 | Cheng et al. | |
| 2018/0227445 | A1 | 8/2018 | Minegishi | |
| 2018/0233821 | A1 | 8/2018 | Pham et al. | |
| 2018/0270729 | A1 | 9/2018 | Ramachandra et al. | |
| 2018/0337445 | A1 | 11/2018 | Sullivan et al. | |
| 2019/0067813 | A1 | 2/2019 | Igura | |
| 2019/0221931 | A1 | 7/2019 | Black et al. | |
| 2019/0289482 | A1 | 9/2019 | Black | |

FOREIGN PATENT DOCUMENTS

| | | | |
|---|---|---|---|
| JP | 936656 | A | 2/1997 |
| JP | 2007081648 | A | 3/2007 |
| JP | 2007306273 | A | 11/2007 |
| JP | 2014207626 | A | 10/2014 |
| JP | 2017-220825 | A | 12/2017 |
| KR | 10 2016 0113100 | A | 9/2016 |
| WO | 2012050614 | A1 | 4/2012 |
| WO | 2015196044 | A1 | 12/2015 |
| WO | 2017014842 | A1 | 1/2017 |
| WO | 2018179870 | A1 | 10/2018 |

OTHER PUBLICATIONS

U.S. Appl. No. 14/510,947, filed Oct. 9, 2014, pp. 1-76.
Office Communication for U.S. Appl. No. 16/049,630 dated Oct. 4, 2018, pp. 1-13.
Office Communication for U.S. Appl. No. 15/870,758 dated Oct. 1, 2018, pp. 1-12.
Office Communication for U.S. Appl. No. 16/136,119 dated Nov. 23, 2018, pp. 1-12.
Office Communication for U.S. Appl. No. 16/136,119 dated Mar. 15, 2019, pp. 1-8.
Office Communication for U.S. Appl. No. 16/292,022 dated Jun. 7, 2019, pp. 1-13.
Office Communication for U.S. Appl. No. 16/049,630 dated Apr. 12, 2019, pp. 1-13.
Office Communication for U.S. Appl. No. 16/268,469 dated May 16, 2019, pp. 1-16.
Office Communication for U.S. Appl. No. 16/280,939 dated May 13, 2019, pp. 1-22.
Office Communication for U.S. Appl. No. 16/440,815 dated Jul. 17, 2019, pp. 1-16.
Office Communication for U.S. Appl. No. 16/358,112 dated May 15, 2019, pp. 1-17.
International Search Report and Written Opinion for International Application No. PCT/US2019/022942 dated Jul. 4, 2019, pp. 1-12.
Yurduseven, Okan et al., "Dual-Polarization Printed Holographic Multibeam Metasurface. Antenna" Aug. 7, 2017, IEEE Antennas and Wireless Propagation Letters. pp. 10.1109/LAWP.2017, pp. 1-4.
International Search Report and Written Opinion for International Application No. PCT/US2019/022987 dated Jul. 2, 2019, pp. 1-13.
Office Communication for U.S. Appl. No. 16/049,630 dated Jun. 24, 2019, pp. 1-5.
Office Communication for U.S. Appl. No. 16/280,939 dated Jul. 18, 2019, pp. 1-7.
Office Communication for U.S. Appl. No. 16/049,630 dated Aug. 7, 2019, pp. 1-13.
Office Communication for U.S. Appl. No. 16/292,022 dated Sep. 23, 2019, pp. 1-9.
Office Communication for U.S. Appl. No. 16/440,815 dated Oct. 7, 2019, pp. 1-5.
Office Communication for U.S. Appl. No. 16/268,469 dated Sep. 10, 2019, pp. 1-11.

(56) References Cited

OTHER PUBLICATIONS

International Search Report and Written Opinion for International Application No. PCT/US2019/041053 dated Aug. 27, 2019, pp. 1-15.
Office Communication for U.S. Appl. No. 16/568,096 dated Oct. 24, 2019, pp. 1-10.
International Search Report and Written Opinion for International Application No. PCT/US2019/047093 dated Oct. 21, 2019, pp. 1-14.
Office Communication for U.S. Appl. No. 16/049,630 dated Dec. 9, 2019, pp. 1-13.
Office Communication for U.S. Appl. No. 16/440,815 dated Jan. 8, 2020, pp. 1-8.
Office Communication for U.S. Appl. No. 16/730,932 dated Mar. 6, 2020, pp. 1-14.
Office Communication for U.S. Appl. No. 16/049,630 dated Mar. 31, 2020, pp. 1-16.
Office Communication for U.S. Appl. No. 16/734,195 dated Mar. 20, 2020, pp. 1-9.
Office Communication for U.S. Appl. No. 16/846,670 dated Jun. 11, 2020, pp. 1-12.
Office Communication for U.S. Appl. No. 16/673,852 dated Jun. 24, 2020, pp. 1-11.
International Search Report and Written Opinion for Application No. PCT/US2020/016641 dated Apr. 14, 2020, pp. 1-12.
Gao, S.S. et al., "Holographic Artificial Impedance Surface Antenna Based on Circular Patch", 2018 International Conference on Microwave and Millimeter Wave Technology (ICMMT), 2018, pp. 1-9.
Nishiyama,Eisuke et al., "Polarization Controllable Microstrip Antenna using Beam Lead PIN Diodes", 2006 Asia-Pacific Microwave Conference, 2006, pp. 1-4.
International Search Report and Written Opinion for Application No. PCT/US2020/013713 dated Apr. 21, 2020, pp. 1-9.
Office Communication for U.S. Appl. No. 16/049,630 dated Aug. 19, 2020, pp. 1-18.
Office Communication for U.S. Appl. No. 16/730,932 dated Aug. 25, 2020, pp. 1-5.
Office Communication for U.S. Appl. No. 16/983,978 dated Sep. 16, 2020, pp. 1-7.
Office Communication for U.S. Appl. No. 16/049,630 dated Oct. 15, 2020, pp. 1-16.
Office Communication for U.S. Appl. No. 16/983,978 dated Oct. 27, 2020, pp. 1-13.
International Search Report and Written Opinion for Application No. PCT/US2020/048806 dated Nov. 17, 2020, pp. 1-15.
Office Communication for U.S. Appl. No. 16/673,852 dated Nov. 25, 2020, pp. 1-8.
Office Communication for U.S. Appl. No. 16/846,670 dated Nov. 25, 2020, pp. 1-13.

* cited by examiner

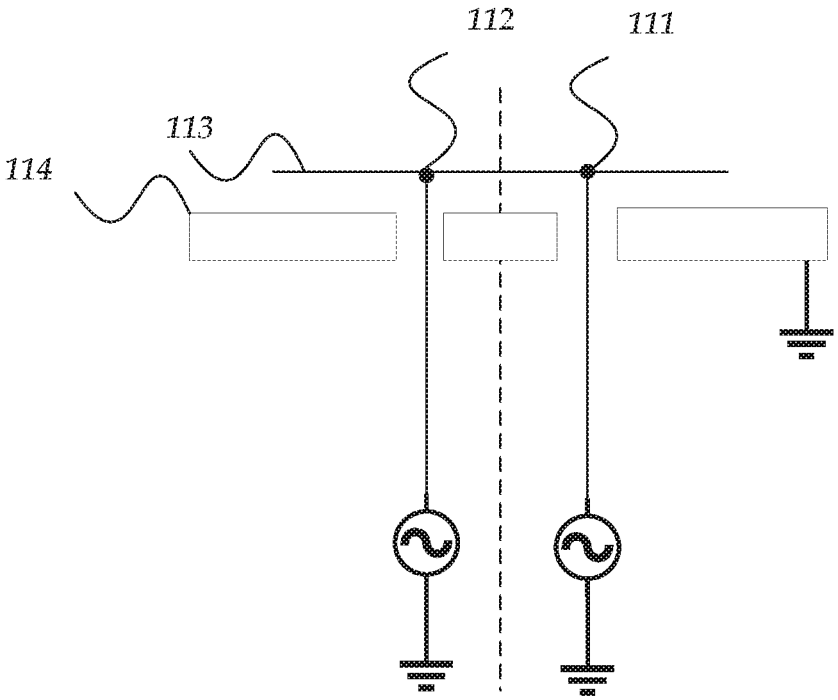
FIG. 1A - PRIOR ART
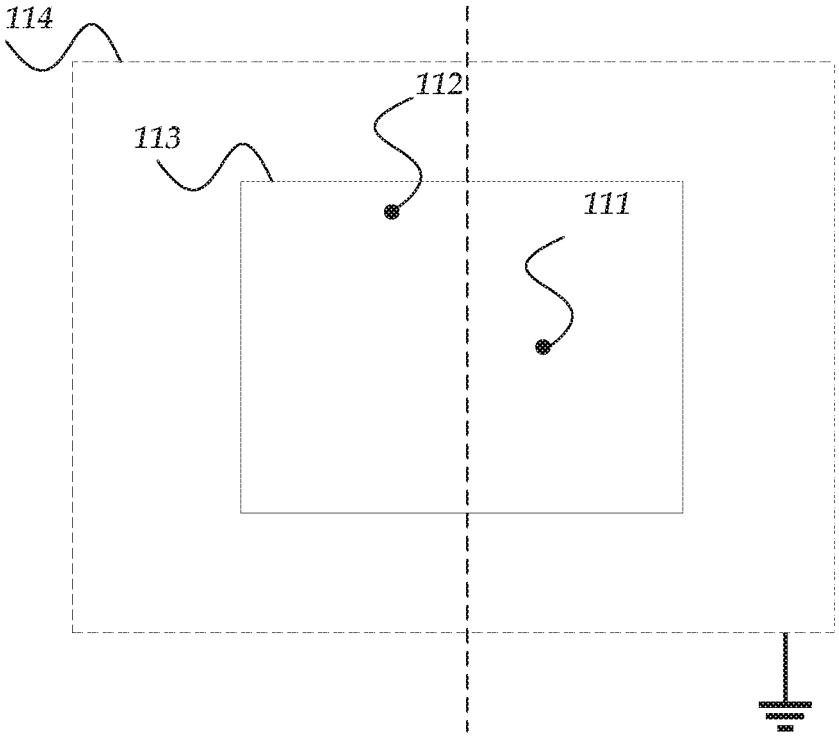
FIG. 1B – PRIOR ART

Z1 = Z2

Z1 >> Z2

Z1 << Z2

HORIZONTALLY POLARIZED SIGNAL WITH SWITCHABLE PHASE SHIFT

*VERTICALLY POLARIZED SIGNAL WITH SWITCHABLE PHASE SHIFT*

DUAL POLARIZATION PATCH ANTENNA SYSTEM

CROSS-REFERENCE TO RELATED APPLICATIONS

This Utility Patent Application is a Continuation of U.S. patent application Ser. No. 16/734,195 filed on Jan. 3, 2020, now U.S. Pat. No. 10,734,736 issued on Aug. 4, 2020, the benefit of which is claimed under 35 U.S.C. § 120, and the contents of which is further incorporated in entirety by reference.

TECHNICAL FIELD

This antenna relates to a patch antenna, and in particular to a dual polarization patch antenna that improves cross polarization isolation of concurrent radiation of horizontal and vertical sinusoidal signals suitable, but not exclusively, for telecommunication.

BACKGROUND

Patch (or microstrip) antennas typically include a flat metal sheet mounted over a larger metal ground plane. The flat metal sheet usually has a rectangular shape, and the metal layers are generally separated using a dielectric spacer. The flat metal sheet has a length and a width that can be optimized to provide a desired input impedance and frequency response. A dual polarization patch antenna can be configured to concurrently radiate horizontally and vertically polarized sinusoidal signals. Dual polarization patch antennas are popular because of their simple design, low profile, light weight, and low cost. An exemplary dual polarization patch antenna is shown in FIGS. 1A and 1B.

Additionally, multiple patch antennas on the same printed circuit board may be employed by high gain array antennas, phased array antennas, or holographic metasurface antennas (HMA), in which a beam of radiated waveforms for a radio frequency (RF) signal or microwave frequency signal may be electronically shaped and/or steered by large arrays of the patch antennas. An exemplary HMA antenna and a beam of radiated waveforms is shown in FIGS. 1C and 1D. Historically, the individual patch antennas are physically grouped closely together to shape and steer a beam of radiated waveforms for horizontally and/or vertically polarized sinusoidal signals. Unfortunately, cross polarization isolation of concurrently radiated horizontally and vertically polarized signals may be degraded by mutual coupling because of the close physical proximity of dual polarization patch antennas employed to radiate millimeter RF waveforms. New designs are constantly sought to improve performance, reduce mutual coupling, and further reduce cost. In view of at least these considerations, the novel inventions disclosed herein were created.

BRIEF DESCRIPTION OF THE DRAWINGS

FIG. 1A illustrates an embodiment of a schematic side view of a dual polarization patch antenna that is arranged to radiate horizontally and vertically polarized signals as known in the prior art;

FIG. 1B shows an embodiment of a schematic top view of a dual polarization patch antenna that is arranged to radiate horizontally and vertically polarized signals as known in the prior art;

DETAILED DESCRIPTION OF EMBODIMENTS OF THE INVENTION

Figure 1C:
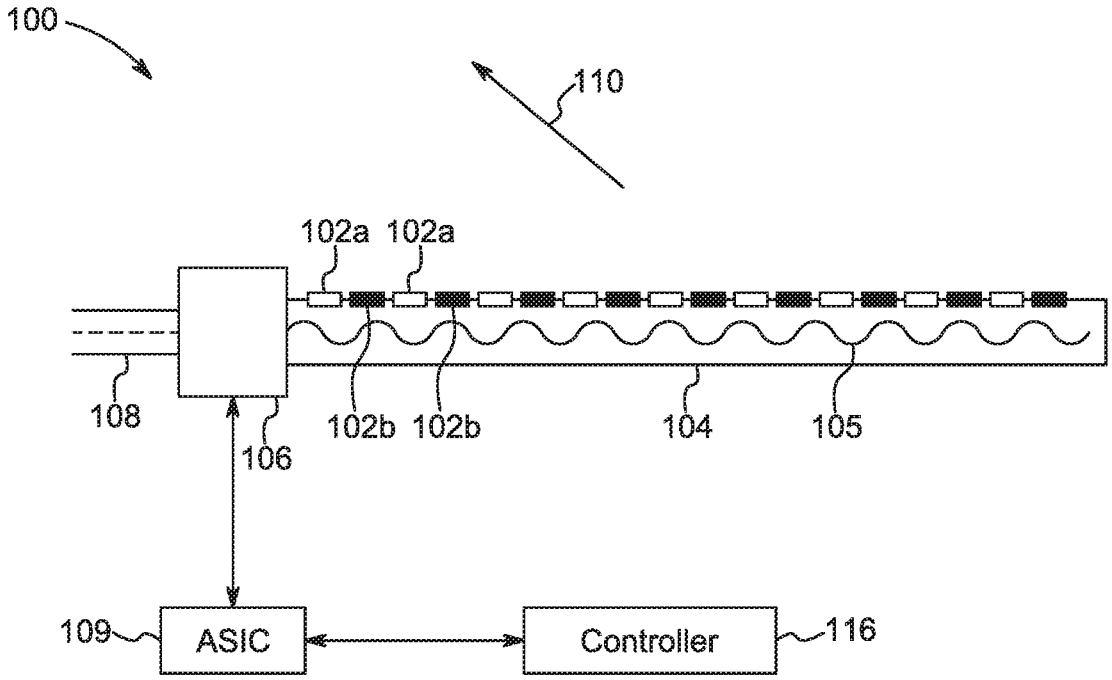
Prior Art FIG. 1C
FIG. 1C shows an embodiment of an exemplary surface scattering antenna with multiple varactor elements to form an exemplary instance of Holographic Metasurface Antennas (HMA)

The present invention now will be described more fully hereinafter with reference to the accompanying drawings, which form a part hereof, and which show, by way of illustration, specific embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as methods or devices. Accordingly, the present invention may take the form of an entirely hardware embodiment, an entirely software embodiment or an embodiment combining software and hardware aspects. The following detailed description is, therefore, not to be taken in a limiting sense.

Throughout the specification and claims, the following terms take the meanings explicitly associated herein, unless the context clearly dictates otherwise. The phrase "in one embodiment" as used herein does not necessarily refer to the same embodiment, though it may. Similarly, the phrase "in another embodiment" as used herein does not necessarily refer to a different embodiment, though it may. As used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

The following briefly describes the embodiments of the invention in order to provide a basic understanding of some aspects of the invention. This brief description is not intended as an extensive overview. It is not intended to identify key or critical elements, or to delineate or otherwise narrow the scope. Its purpose is merely to present some concepts in a simplified form as a prelude to the more detailed description that is presented later.

Briefly stated, various embodiments are directed towards an antenna arranged as a dual polarization patch antenna for concurrently radiating separate horizontally polarized sinusoidal signals and vertically polarized sinusoidal signals with improved cross polarization isolation between the horizontally and vertically polarized sinusoidal signals. An exemplary patch antenna may include a planar conductor that is arranged in a dual polarization mode of radiation having a first terminal and a second terminal that are vertically spaced on the planar conductor to radiate a component of the vertically polarized signal with zero degrees of phase shift from one of the two terminals and another component of the vertically polarized signal with a 180 degrees of phase shift is radiated from the other of the two terminals. A vertically polarized sinusoidal signal source is coupled to the two terminals and provides the first and second components of the vertically polarized signal. Further, a hybrid coupler is connected to the vertically polarized sinusoidal signal source and at least one of the first or second terminals to provide the 180 degrees of phase shift between the first and second components of the vertically polarized signal.

Also, a horizontally polarized sinusoidal signal source is coupled to a third terminal that is horizontally spaced on the planar conductor, and provides a horizontally polarized signal that may be concurrently radiated from the third terminal. The radiation of the first and second components of the vertically polarized signal having a difference of 180 degrees of phase shift improves cross polarization isolation between the vertically and horizontally polarized signals concurrently radiated from the dual polarization patch antenna.

Additionally, a direction of the 180 degree phase shift for the first and second components of the vertically polarized signal may be optionally selected by choosing which of the first or second components is coupled in series with a 180 degree hybrid coupler. Also, a separate phase shift direction of 180 degrees may be optionally selected for the horizontally polarized signal.

In one or more embodiments, the dual polarization patch antenna includes an aperture (hole) formed at the center of the planar conductor. Radiation of a horizontally polarized sinusoidal signal is controlled by comparison of separate impedance values for two elements. Each of the two elements have one end coupled together at the third terminal which is positioned at a center of the aperture and their other ends separately coupled to opposing edges of the aperture. A horizontally polarized sinusoidal signal source, e.g., an alternating current (AC) signal source, is coupled to the third terminal positioned at the aperture's center. Further, when the impedance values of both elements are substantially equivalent, radiation by the antenna of the provided signal and/or mutual coupling of other signals by the third terminal is disabled. Also, when an impedance value of one of the two elements is substantially greater than the other impedance value of the other element, the provided signal is radiated In one or more embodiments, a positive waveform of the horizontally polarized signal is radiated towards the element having an impedance value substantially less than another impedance value of the other element. In this way, a phase of the radiated horizontally polarized signal may be shifted 180 degrees based on which of the two elements provides an impedance value substantially less than the other impedance value provided by the other element.

In one or more embodiments, a first element provides a fixed impedance value and the second element provides a variable impedance value. Further, the variable impedance value of the second element may be provided by one or more of an electronic switch, mechanical switch, varactor, relay, or the like. In one or more embodiments, when a switch is conducting (closed) its variable impedance value is relatively low, e.g., one ohm, and when the switch is non-conducting (open) the variable impedance value may be infinity. Thus, when the non-conducting switch's variable impedance value is substantially greater (infinity) than the fixed impedance value of the first element, a horizontally polarized signal is radiated at the third terminal by the antenna. Conversely, the horizontally polarized signal is non-radiated when the second element's switch is conducting and it's variable impedance value is substantially equivalent to the fixed impedance value.

In one or more embodiments, a fixed impedance value may be provided for the first or second element during manufacture of the dual polarization patch antenna, e.g., a metal wire, metallic trace, extended segment of the planar surface, resistor, capacitor, inductor, or the like that provides a known (fixed) impedance value between the centrally located third terminal and an edge of the aperture. Further, in one or more embodiments, during manufacture of the dual polarization patch antenna, a low level (conducting) of a variable impedance value provided by one of the two elements is selected to be substantially equivalent to a fixed impedance value or a low level (conducting) of another variable impedance value provided by the other of the two elements. Additionally, a high level (non-conducting) of a variable impedance value provided by one of the two elements is selected to be substantially greater than a fixed impedance value or the low level (conducting) of another variable impedance value provided by the other of the two elements.

In one or more embodiments, a direct current (DC) ground is coupled to one or more portions of the planar conductor to help with impedance match, radiation patterns and be part of a bias for one or more elements. Also, in one or more embodiments, a shape of the aperture formed in the planar conductor can include rectangular, square, triangular, circular, curved, elliptical, quadrilateral, polygon, or the like.

In one or more embodiments, a length of the aperture is one half of a wavelength (lambda) of the signal. Also, in one or more embodiments, the signal comprises a radio frequency signal, a microwave frequency signal, or the like. Further, the horizontally polarized sinusoidal signal and/or the vertically polarized sinusoidal signal may be provided by an electronic circuit, a signal generator, a waveguide, or the like.

Additionally, in one or more embodiments, a holographic metasurface antennas (HMA) is employed that uses a plurality of the switchable patch antennas as scattering elements to radiate shaped and steered beams based on the provided AC signal. And any signal radiated by any of the plurality of switchable patch antennas, or any other resonant structures, is not mutually coupled to those switchable patch antennas that have their switch operating in a conduction state (closed).

Also, in one or more embodiments, to further reduce mutual coupling between closely located antennas, e.g., an array of antennas in an HMA, a distance between the planar conductors of these antennas may be arranged to be no more than a length of the radiated waveform of the provided signal divided by three and no less than a length of the waveform divided by eleven.

An exemplary prior art embodiment of a schematic side view of a non-switchable dual polarization patch antenna is shown in FIG. 1A. Further, an exemplary embodiment of a schematic top view is shown in FIG. 1B. As shown, the dual polarization patch antenna is well known in the prior art and consists of a top planar (flat) sheet 113 or "patch" of conductive material such as metal, mounted over a larger planar sheet of metal 114 that operates as a ground plane. These two planar conductors are arranged to form a resonant part of a microstrip transmission line, and the top planar conductor is arranged to have a length of approximately one-half of a length of a signal waveform that the patch antenna is intended to radiate. A vertically polarized sinusoidal signal input to the top planar sheet 113 is provided at terminal 112 which is offset from a center of the top planar sheet. Similarly, a horizontally polarized sinusoidal signal input to the top planar sheet 113 is separately provided at terminal 111 which is offset from a center of the top planar sheet. Radiation of the vertically polarized and horizontally polarized sinusoidal signal waveforms is caused in part by discontinuities at the truncated edge of the top planar conductor (patch). Also, since the radiation occurs at the truncated edges of the top patch, the patch antenna acts slightly larger than its physical dimensions. Thus, for a patch antenna to be resonant (capacitive load equal to the inductive load), a length of the top planar conductor (patch) is typically arranged to be slightly shorter than one-half of the wavelength of the radiated waveforms.

In some embodiments, when a dual polarization patch antenna is used at microwave frequencies, the wavelengths of the vertically polarized and horizontally polarized signals are short enough that the physical size of the dual polarization patch antenna can be small enough to be included in portable wireless devices, such as mobile phones. Also, dual polarization patch antennas may be manufactured directly on the substrate of a printed circuit board.

In one or more embodiments, an HMA may use an arrangement of controllable scattering elements (antennas) to produce an object wave. Also, in one or more embodiments, these controllable antennas may employ individual electronic circuits, such as varactors, that have two or more different states. In this way, an object wave can be modified by changing the states of the electronic circuits for one or more of the controllable antennas. A control function, such as a hologram function, can be employed to define a current state of the individual controllable antennas for a particular object wave. In one or more embodiments, the hologram function can be predetermined or dynamically created in real time in response to various inputs and/or conditions. In one or more embodiments, a library of predetermined hologram functions may be provided. In the one or more embodiments, any type of HMA can be used to that is capable of producing the beams described herein.

FIG. 1C illustrates one embodiment of a prior art HMA which takes the form of a surface scattering antenna 100 (i.e., an HMA) that includes multiple scattering elements (antennas) 102*a*, 102*b* that are distributed along a wave-propagating structure 104 or other arrangement through which a reference wave 105 can be delivered to the scattering elements. The wave propagating structure 104 may be, for example, a microstrip, a coplanar waveguide, a parallel plate waveguide, a dielectric rod or slab, a closed or tubular waveguide, a substrate-integrated waveguide, or any other structure capable of supporting the propagation of a reference wave 105 along or within the structure. A reference wave 105 is input to the wave-propagating structure 104. The scattering elements 102*a*, 102*b* may include scattering elements that are embedded within, positioned on a surface of, or positioned within an evanescent proximity of, the wave-propagation structure 104. Examples of such scattering elements include, but are not limited to, those disclosed in U.S. Pat. Nos. 9,385,435; 9,450,310; 9,711,852; 9,806,414; 9,806,415; 9,806,416; and 9,812,779 and U.S. Patent Applications Publication Nos. 2017/0127295; 2017/0155193; and 2017/0187123, all of which are incorporated herein by reference in their entirety. Also, any other suitable types or arrangement of scattering elements can be used.

The surface scattering antenna may also include at least one feed connector 106 that is configured to couple the wave-propagation structure 104 to a feed structure 108 which is coupled to a reference wave source (not shown). The feed structure 108 may be a transmission line, a waveguide, or any other structure capable of providing an electromagnetic signal that may be launched, via the feed connector 106, into the wave-propagating structure 104. The feed connector 106 may be, for example, a coaxial-to-microstrip connector (e.g. an SMA-to-PCB adapter), a coaxial-to-waveguide connector, a mode-matched transition section, etc.

The scattering elements 102*a*, 102*b* are adjustable scattering antennas having electromagnetic properties that are adjustable in response to one or more external inputs. Adjustable scattering elements can include elements that are adjustable in response to voltage inputs (e.g. bias voltages for active elements (such as varactors, transistors, diodes) or for elements that incorporate tunable dielectric materials (such as ferroelectrics or liquid crystals)), current inputs (e.g. direct injection of charge carriers into active elements), optical inputs (e.g. illumination of a photoactive material), field inputs (e.g. magnetic fields for elements that include nonlinear magnetic materials), mechanical inputs (e.g. MEMS, actuators, hydraulics), or the like. In the schematic example of FIG. 1C, scattering elements that have been adjusted to a first state having first electromagnetic properties are depicted as the first elements 102*a*, while scattering elements that have been adjusted to a second state having second electromagnetic properties are depicted as the second elements 102*b*. The depiction of scattering elements having first and second states corresponding to first and second electromagnetic properties is not intended to be limiting: embodiments may provide scattering elements that are discretely adjustable to select from a discrete plurality of states corresponding to a discrete plurality of different electromagnetic properties, or continuously adjustable to select from a continuum of states corresponding to a continuum of different electromagnetic properties.

Figure 1D:
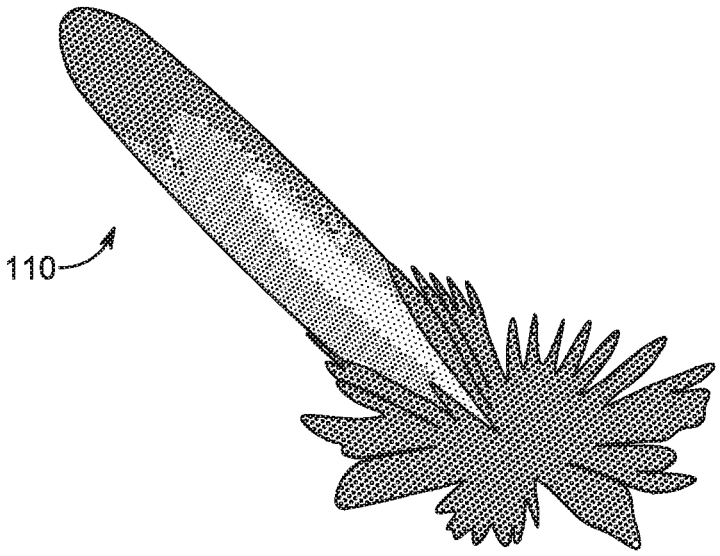
Prior Art FIG. 1D
FIG. 1D shows an embodiment of an exemplary beam of electromagnetic wave forms radiated by the Holographic Metasurface Antennas (HMA) shown in FIG. 1C.

In the example of FIG. 1C, the scattering elements 102*a*, 102*b* have first and second couplings to the reference wave 105 that are functions of the first and second electromagnetic properties, respectively. On account of the first and second couplings, the first and second scattering elements 102*a*, 102*b* are responsive to the reference wave 105 to produce a plurality of scattered electromagnetic waves having amplitudes that are functions of (e.g. are proportional to) the respective first and second couplings. Additionally, FIG. 1D shows an embodiment of an exemplary beam of electromagnetic wave forms generated by the HMA shown in FIG. 1C. A superposition of the scattered electromagnetic waves comprises an electromagnetic wave that is depicted, in this example, as an object wave 110 that radiates from the surface scattering antenna 100.

Figure 1E:
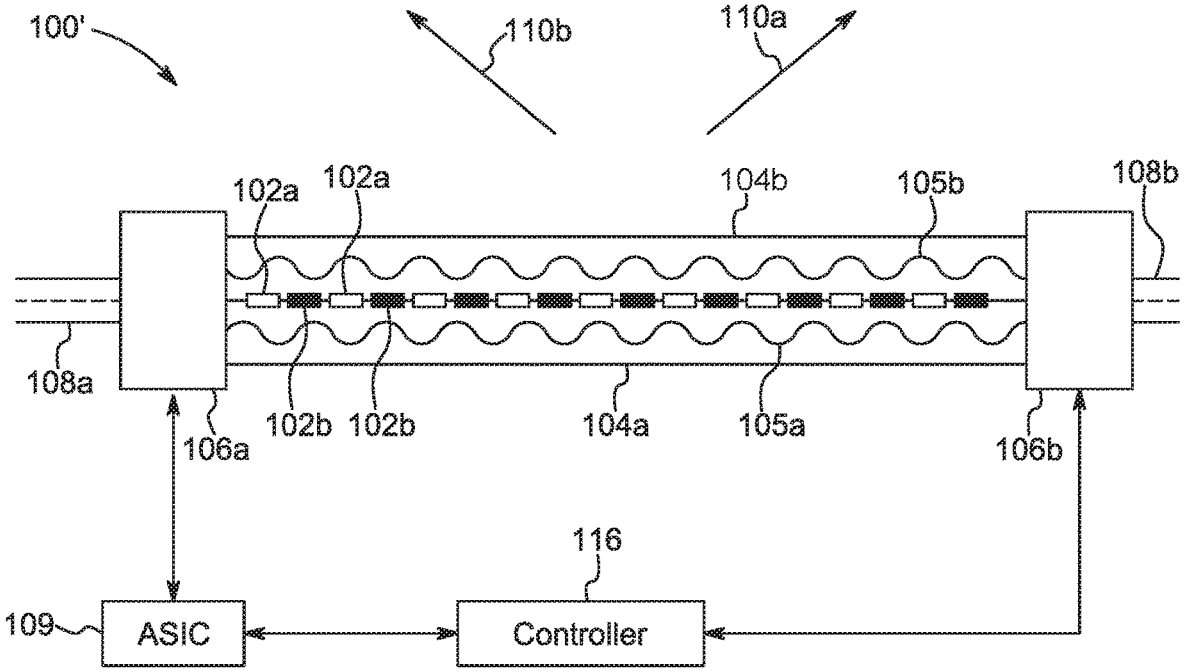
FIG. 1E shows an embodiment of an exemplary dual polarization surface scattering antenna with multiple varactor elements to form an exemplary instance of Holographic Metasurface Antennas (HMA)

FIG. 1E shows an embodiment of an exemplary dual polarization surface scattering antenna with multiple varactor elements to form an exemplary instance of Holographic Metasurface Antennas (HMA). The HMA which takes the form of a surface scattering antenna 100' that includes multiple scattering elements (antennas) 102*a*, 102*b* that are distributed along wave-propagating structures 104*a* and 104*b* or other arrangement through which reference waves 105*a* and 105*b* can be delivered to the scattering elements. The wave propagating structures 104*a* and 104*b* may be, for example, a microstrip, a coplanar waveguide, a parallel plate waveguide, a dielectric rod or slab, a closed or tubular waveguide, a substrate-integrated waveguide, or any other structure capable of supporting the propagation of reference waves 105*a* and 105*b* along or within the structures. Reference waves 105*a* and 105*b* are input to the wave-propagating structures 104*a* and 104*b*. The scattering elements 102*a*, 102*b* may include scattering elements that are embedded within, positioned on a surface of, or positioned within an evanescent proximity of, the wave-propagation structures 104*a* and 104*b*. Also, any other suitable types or arrangement of scattering elements can be used.

The surface scattering antenna 100' may also include at least two feed connectors 106*a* and 106*b* that are configured to couple the wave-propagation structures 104*a* and 104*b* to feed structures 108*a* and 108*b*, which are coupled to reference wave sources (not shown). The feed structures 108*a* and 108*b* may be transmission lines, waveguides, or any other structure capable of providing an electromagnetic signal that may be launched, via the feed connectors 106*a* and 106*b*, into the wave-propagating structures 104*a* and 104*b*. The feed connectors 106*a* and 106*b* may be, for example, a coaxial-to-microstrip connector (e.g. an SMA-to-PCB adapter), a coaxial-to-waveguide connector, a mode-matched transition section, etc.

The scattering elements 102*a*, 102*b* are adjustable scattering antennas having electromagnetic properties that are adjustable in response to one or more external inputs. Adjustable scattering elements can include elements that are adjustable in response to voltage inputs (e.g. bias voltages for active elements (such as varactors, transistors, diodes) or for elements that incorporate tunable dielectric materials (such as ferroelectrics or liquid crystals)), current inputs (e.g. direct injection of charge carriers into active elements), optical inputs (e.g. illumination of a photoactive material), field inputs (e.g. magnetic fields for elements that include nonlinear magnetic materials), mechanical inputs (e.g. MEMS, actuators, hydraulics), or the like. In the schematic example of FIG. 1E, scattering elements that have been adjusted to a first state having first electromagnetic properties are depicted as the first elements 102*a*, while scattering elements that have been adjusted to a second state having second electromagnetic properties are depicted as the second elements 102*b*. The depiction of scattering elements having first and second states corresponding to first and second electromagnetic properties is not intended to be limiting: embodiments may provide scattering elements that are discretely adjustable to select from a discrete plurality of states corresponding to a discrete plurality of different electromagnetic properties, or continuously adjustable to select from a continuum of states corresponding to a continuum of different electromagnetic properties.

In the example of FIG. 1E, the scattering elements 102*a*, 102*b* have first and second couplings to the reference waves 105*a* and 105*b* that are functions of the first and second electromagnetic properties, respectively. On account of the first and second couplings, the first and second scattering elements 102*a*, 102*b* are responsive to the reference waves 105*a* and 105*b* to produce a plurality of scattered electromagnetic waves having amplitudes that are functions of (e.g. are proportional to) the respective first and second couplings.

Figure 1F:
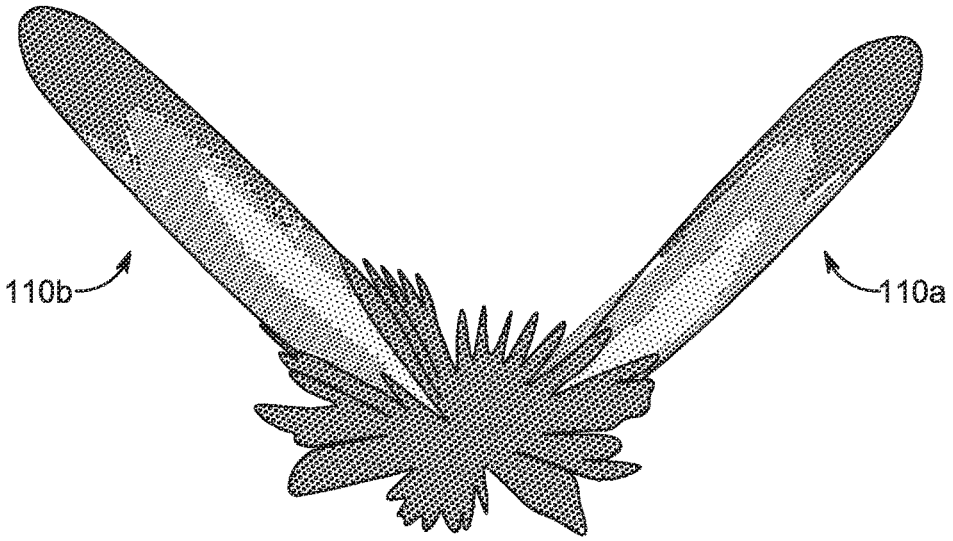
FIG. 1F shows an embodiment of two exemplary beams of electromagnetic wave forms that are concurrently radiated and separately polarized by the Holographic Metasurface Antennas (HMA) shown in FIG. 1E.

Additionally, FIG. 1F shows an embodiment of an exemplary independent dual-polarization beam of electromagnetic wave forms radiated by the Holographic Metasurface Antennas (HMA) shown in FIG. 1E. A superposition of the scattered electromagnetic waves comprises an electromagnetic wave that is depicted, in this example, as object waves 110*a* and 110*b* that radiate from the surface scattering antenna 100'.

Also, as shown in FIGS. 1E and 1F, HMA 100' is arranged to provide for concurrent radiation of dual polarized signals, e.g., horizontally and vertically polarized signals that are coupled to the same elements 102*a* and 102*b*. In this way, HMA 100' may generate a separate horizontally polarized beam 110*a* that can be scanned independently of vertically polarized beam 110*b*.

FIGS. 1C and 1E illustrate a one-dimensional array of scattering elements 102*a*, 102*b*. It will be understood that two- or three-dimensional arrays can also be used. In addition, these arrays can have different shapes. Moreover, the array illustrated in FIG. 1C is a regular array of scattering elements 102*a*, 102*b* with equidistant spacing between adjacent scattering elements, but it will be understood that other arrays may be irregular or may have different or variable spacing between adjacent scattering elements. Also, Application Specific Integrated Circuit (ASIC) 109 is employed to control the operation of the row of scattering elements 102*a* and 102*b*. Further, controller 116 may be employed to control the operation of one or more ASICs that control one or more rows in the array.

The array of scattering elements 102*a*, 102*b* can be used to produce a far-field beam pattern that at least approximates a desired beam pattern by applying a modulation pattern (e.g., a hologram function, H) to the scattering elements receiving the reference wave ($\psi_{ref}$) from a reference wave source. Although the modulation pattern or hologram function is illustrated as sinusoidal, it will be recognized non-sinusoidal functions (including non-repeating or irregular functions) may also be used.

In at least some embodiments, the hologram function H (i.e., the modulation function) is equal to the complex conjugate of the reference wave and the object wave, i.e., $\psi_{ref}^*\psi_{obj}$. In at least some embodiments, the surface scattering antenna may be adjusted to provide, for example, a selected beam direction (e.g. beam steering), a selected beam width or shape (e.g. a fan or pencil beam having a broad or narrow beam width), a selected arrangement of nulls (e.g. null steering), a selected arrangement of multiple beams, a selected polarization state (e.g. linear, circular, or elliptical polarization), a selected overall phase, or any combination thereof. Alternatively, or additionally, embodiments of the surface scattering antenna may be adjusted to provide a selected near field radiation profile, e.g. to provide near-field focusing or near-field nulls.

Also, although not shown, the invention is not limited to a varactor as a control element that enables a scattering element to emit a signal. Rather, many different types of control elements may be employed in this way. For example, one or more other embodiments may instead employ Field Effect Transistors (FETs), Microelectromechanical Systems (MEMS), Bipolar Junction Transistors (BSTs), or the like to enable scattering elements to turn on and turn off emitting the signal.

Additionally, the phrase "dual polarization" is employed to reference two orthogonal polarizations that may concurrently radiate signals from the same antenna. Although horizontal and vertical polarizations are used as two exemplary orthogonal polarizations in the Specification, dual polarization applies to any other types of two orthogonal polarizations. For example, plus 45 degree slant polarization and minus 45 degree polarization are two orthogonal polarizations that may be provided to concurrently radiate signals. Also, left circular polarization and right circular polarization may be generated by connecting a 90 degree hybrid coupler to two feedlines that provide the signals.

Illustrated Operating Environment

Figure 2A:
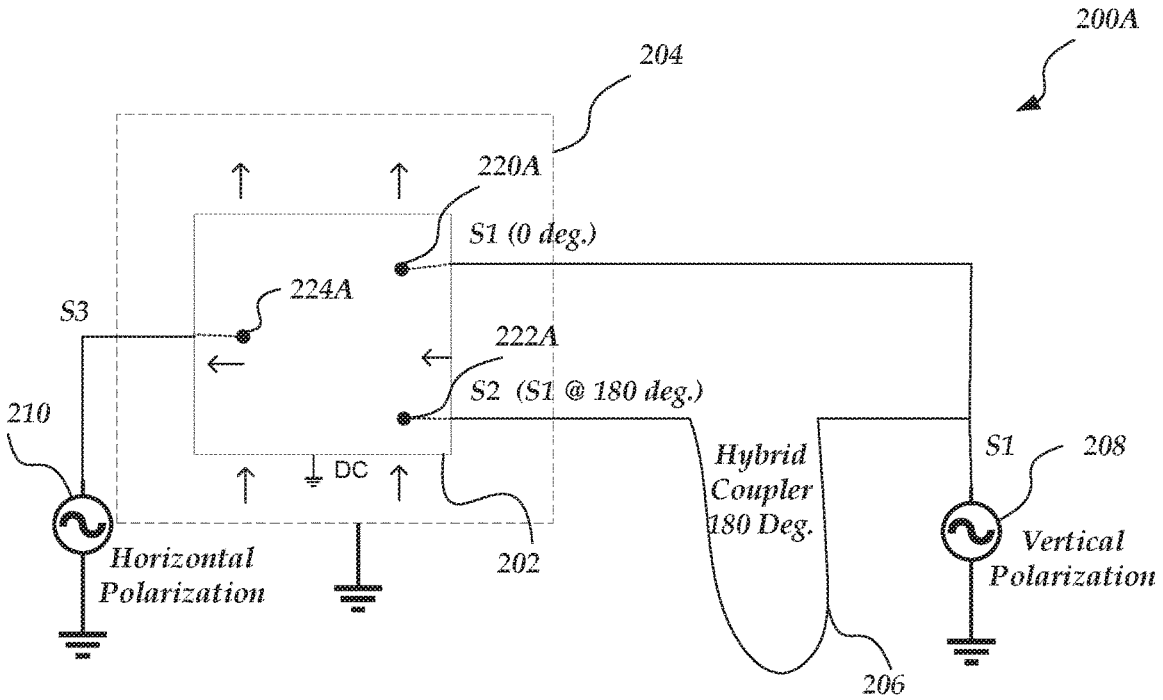
FIG. 2A illustrates a schematic top view of an exemplary dual polarization patch antenna, wherein two terminals are vertically spaced on the patch antenna to radiate a component of a vertically polarized signal with zero degrees of phase shift from a first terminal and radiate another component of the vertically polarized signal with 180 degrees of phase shift from a second terminal, and wherein a horizontally polarized signal may be concurrently radiated from a third terminal that is horizontally spaced on the patch antenna.

FIG. 2A illustrates a schematic top view of an exemplary dual polarization patch antenna 200A. Two terminals 220A and 222A are vertically spaced on planar conductor 202, which are coupled to vertically polarized sinusoidal signal source 208. Terminal 224A is horizontally spaced on planar conductor 202, which is coupled to horizontally polarized sinusoidal signal source 210. Further, a direct current ground may be coupled to planar conductor 202. Also, planar conductor 202 is mounted over a larger planar conductor 204 that operates as a ground plane for the planar conductor 202.

Additionally, at terminal 220A, a component of a vertically polarized signal with zero degrees of phase shift is radiated. As shown, terminal 220A is coupled in series with vertically polarized signal source 208. At terminal 222A, another component of the vertically polarized signal with 180 degrees of phase shift is radiated. Terminal 222A is coupled in series with a 180 degrees of phase shift hybrid coupler to vertically polarized signal source 208. Also, a horizontally polarized signal is radiated from terminal 224A, which is coupled in series with horizontally polarized sinusoidal signal source 210. Further, the horizontally polarized signal and the two components of the vertically polarized signal may be concurrently radiated by dual polarization patch antenna 200A.

Figure 2B:
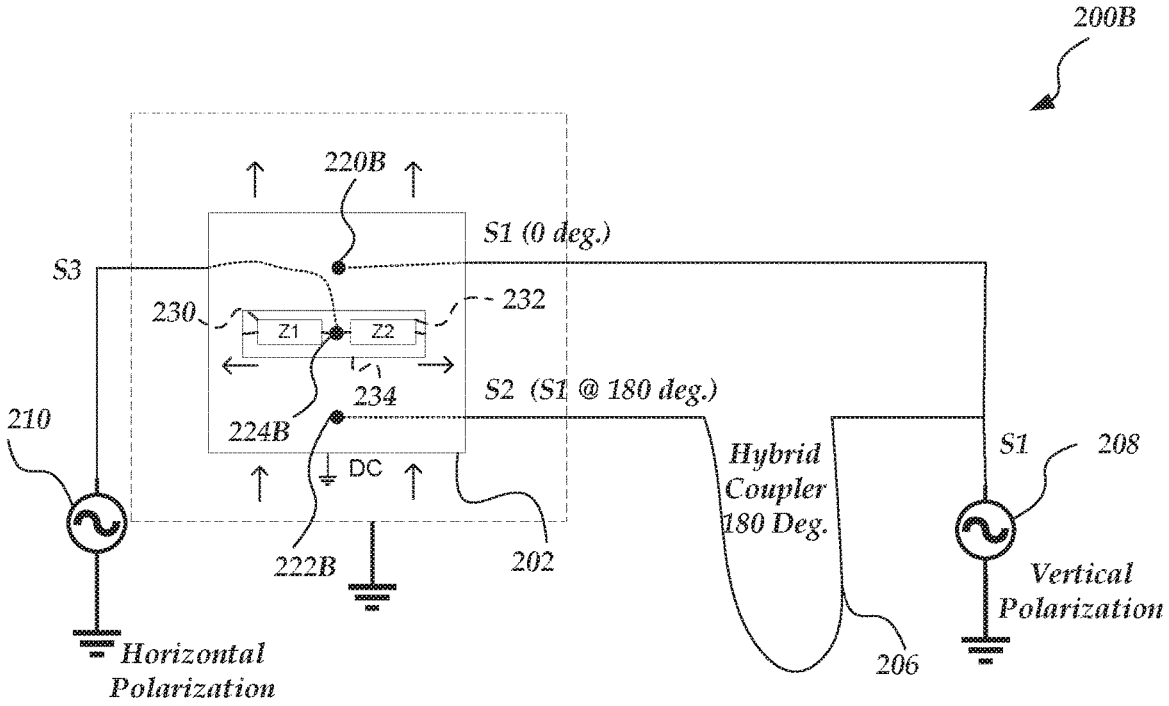
FIG. 2B shows a schematic top view of an exemplary switchable dual polarization patch antenna, wherein two terminals are vertically spaced on the patch antenna to radiate one component of a vertically polarized signal with zero degrees of phase shift from a first terminal and another component of the vertically polarized signal with 180 degrees of phase shift from a second terminal while a horizontally polarized signal may be concurrently radiated from a third terminal that is horizontally spaced on the patch antenna, and wherein a 0 degree or 180 degree phase shift or an off state of the horizontally polarized signal is provided by an impedance comparator of two elements having separate impedances (Z1 and Z2) that are coupled to each other and the horizontally polarized signal source is provided at a terminal located in a middle of an aperture at a center of the patch antenna.

FIG. 2B illustrates a schematic top view of an exemplary dual polarization patch antenna 200B. Two terminals 220B and 222B are vertically spaced on planar conductor 202, which are separately coupled to vertically polarized sinusoidal signal source 208. Terminal 224B is horizontally spaced on planar conductor 202, which is coupled to horizontally polarized sinusoidal signal source 210. Further, a direct current ground may be coupled to planar conductor 202. Also, planar conductor 202 is mounted over a larger planar conductor 204 that operates as a ground plane for the planar conductor 202.

Additionally, at terminal 220B, a component of a vertically polarized signal with zero degrees of phase shift is radiated. As shown, terminal 220B is coupled in series with vertically polarized signal source 208. At terminal 222B, another component of the vertically polarized signal with 180 degrees of phase shift is radiated. Terminal 222B is coupled in series with a 180 degrees of phase shift hybrid coupler to vertically polarized signal source 208.

Also, a horizontally polarized signal is radiated from terminal 224B, which is coupled in series with horizontally polarized sinusoidal signal source 210. Also, terminal 224B operates as an impedance comparator between an impedance value Z1 for component 230 and an impedance value Z2 for component 232. These components are coupled between center terminal 224B and opposing edges of aperture 234, located in a middle of planar conductor 202. In one or more embodiments, at least one of the impedance values is variable to a high level and a low level while the other impedance value is fixed at a low level. In one or more embodiments, one of impedance values Z1 or Z2 is a fixed impedance value and the other is a variable impedance value that can be switched from a low level substantially equivalent to the fixed impedance value and a high level that is substantially greater than the fixed impedance value. Also, in one or more embodiments, both the impedance values Z1 and Z2 are variable impedance values. Furthermore, the horizontally polarized signal and the two components of the vertically polarized signal may be concurrently radiated by dual polarization patch antenna 200B.

Figure 2C:
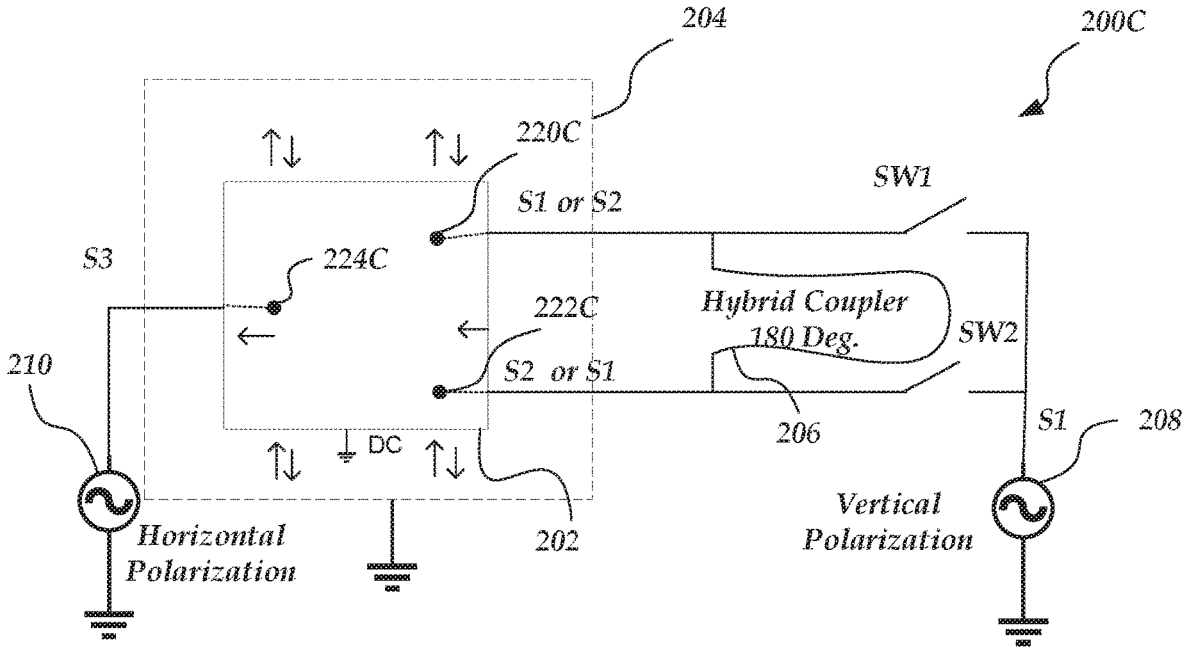
FIG. 2C shows a schematic top view of an exemplary switchable dual polarization patch antenna, wherein two terminals are vertically spaced on the patch antenna to selectively radiate one of two components of a vertically polarized signal with a 180 degree phase shift or zero degrees of phase shift, wherein the selection of the two components is provided by two switches coupled in parallel between a hybrid coupler and the vertically polarized sinusoidal signal source, and wherein a horizontally polarized signal may be concurrently radiated from a third terminal that is horizontally spaced on the patch antenna.

FIG. 2C illustrates a schematic top view of an exemplary dual polarization patch antenna 200C. Two terminals 220C and 222C are vertically spaced on planar conductor 202, which are separately coupled to vertically polarized sinusoidal signal source 208. Terminal 224C is horizontally spaced on planar conductor 202, which is coupled to horizontally polarized sinusoidal signal source 210. Further, a direct current ground may be coupled to planar conductor 202. Also, planar conductor 202 is mounted over a larger planar conductor 204 that operates as a ground plane for planar conductor 202.

Additionally, at terminal 220C, a component of a vertically polarized signal with either zero degrees or 180 degrees of phase shift may be selectively radiated. As shown, terminal 220C is coupled in parallel with hybrid coupler 206 and two switches SW1 and SW2 to vertically polarized signal source 208. At terminal 222C, another component of the vertically polarized signal with either zero degrees or 180 degrees of phase shift may be selectively radiated. Terminal 222C is also coupled in parallel with hybrid coupler 206 and two switches SW1 and SW2 to vertically polarized signal source 208. The opposite opening and closing of the two switches selects whether terminals 220C and 222C may radiate components of the vertically polarized signal, and if so, which of the two terminals radiates a component with zero degrees of phase shift or the other component with 180 degrees of phase shift. Also, a horizontally polarized signal is radiated from terminal 224C, which is coupled in series with horizontally polarized sinusoidal signal source 210. Furthermore, the horizontally polarized signal and the two components of the vertically polarized signal may be concurrently radiated by dual polarization patch antenna 200C.

Figure 2D:
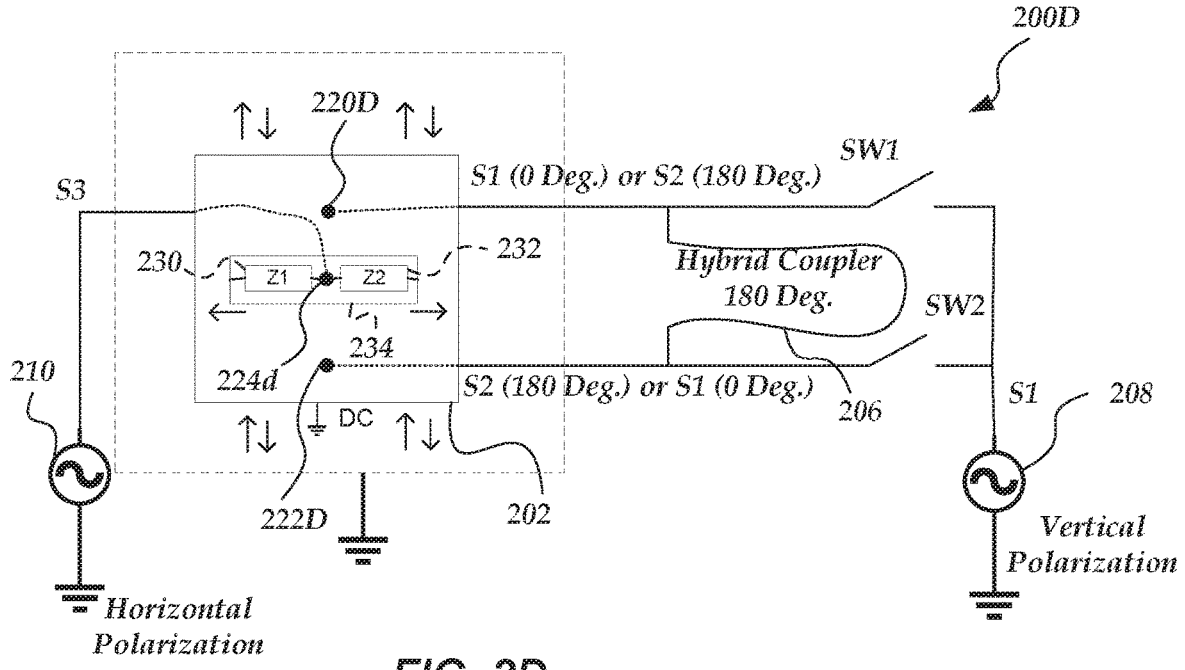
FIG. 2D shows a schematic top view of an exemplary switchable dual polarization patch antenna, wherein two terminals are vertically spaced on the patch antenna to separately radiate two components of a vertically polarized sinusoidal signal, wherein a 180 degree phase shift for one component of the vertically polarized signal is provided to either of the two terminals is provided by two switches coupled in parallel between a 180 degree hybrid coupler and the vertically polarized signal source, and wherein a horizontally polarized signal is concurrently radiated from a third terminal that is horizontally spaced on the patch antenna, and wherein a 180 degree phase shift of the horizontally polarized signal is provided by two elements having separate impedances (Z1 and Z2) that are coupled to each other and the horizontally polarized signal source at a terminal centered in a middle of an aperture at a center of the patch antenna.

FIG. 2D illustrates a schematic top view of an exemplary dual polarization patch antenna 200D. Two terminals 220D and 222D are vertically spaced on planar conductor 202, which are separately coupled to vertically polarized sinusoidal signal source 208. Terminal 224D is horizontally spaced on planar conductor 202, which is coupled to horizontally polarized sinusoidal signal source 210. Further, a direct current ground may be coupled to planar conductor 202. Also, planar conductor 202 is mounted over a larger planar conductor 204 that operates as a ground plane for the planar conductor 202.

Additionally, at terminal 220D, a component of a vertically polarized signal with either zero degrees or 180 degrees of phase shift may be selectively radiated. As shown, terminal 220D is coupled in parallel with hybrid coupler 206 and two switches SW1 and SW2 to vertically polarized signal source 208. At terminal 222D, another component of the vertically polarized signal with either zero degrees or 180 degrees of phase shift may be selectively radiated. Terminal 222D is also coupled in parallel with hybrid coupler 206 and two switches SW1 and SW2 to vertically polarized signal source 208. The opposite opening and closing of the two switches selects whether terminals 220D and 222D may radiate components of the vertically polarized signal, and if so, which of the two terminals radiates a component with zero degrees of phase shift or the other component with 180 degrees of phase shift.

Also, a horizontally polarized signal is radiated from terminal 224D, which is coupled in series with horizontally polarized sinusoidal signal source 210. Also, terminal 224D operates as an impedance comparator between an impedance value Z1 for component 230 and an impedance value Z2 for component 232. These components are coupled between center terminal 224D and opposing edges of aperture 234, located in a middle of planar conductor 202. In one or more embodiments, at least one of the impedance values is variable to a high level and a low level while the other impedance value is fixed at a low level. In one or more embodiments, one of impedance values Z1 or Z2 is a fixed impedance value and the other is a variable impedance value that can be switched from a low level substantially equivalent to the fixed impedance value and a high level that is substantially greater than the fixed impedance value. Also, in one or more embodiments, both the impedance values Z1 and Z2 are variable impedance values. Furthermore, the horizontally polarized signal and the two components of the vertically polarized signal may be concurrently radiated by dual polarization patch antenna 200D.

Figure 2E:
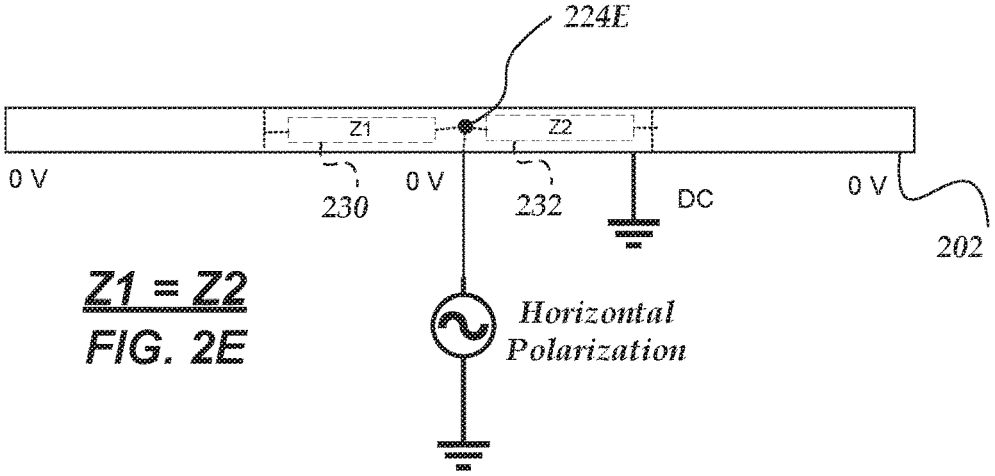
FIG. 2E shows a schematic side view of an exemplary switchable dual polarization patch antenna having selectable phase shift direction for the horizontally polarized signal, wherein the separate impedance values (Z1 and Z2) of a first element and a second element are substantially equivalent to each other and the antenna is not radiating a horizontally polarized signal.

FIG. 2E shows a schematic side view of an exemplary switchable dual polarization patch antenna when the separate impedance values (Z1 and Z2) of element 230 and element 232 are substantially equivalent to each other at terminal 224E. In this case, the antenna is not radiating a horizontally polarized signal.

Figure 2F:
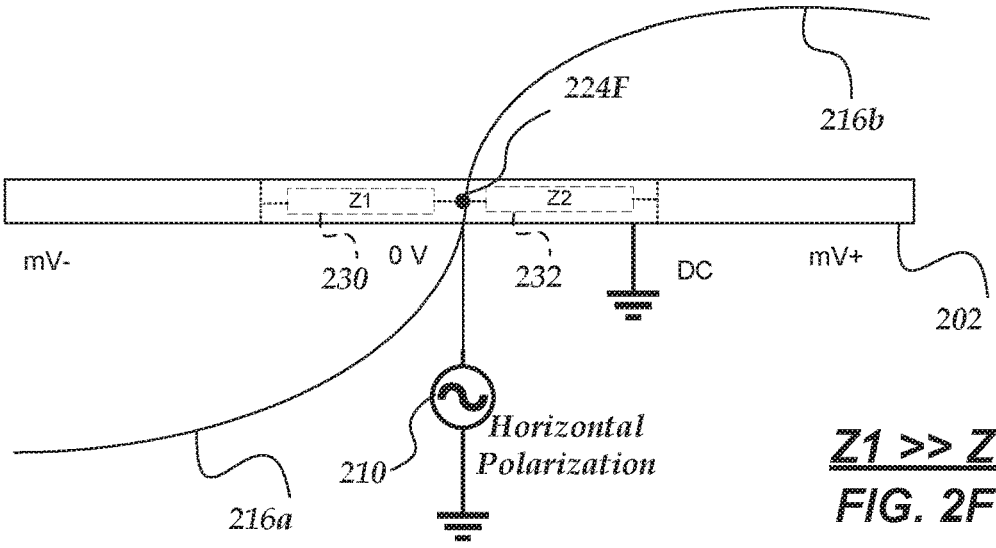
FIG. 2F illustrates a schematic side view of an exemplary switchable dual polarization patch antenna having selectable phase shift direction for the horizontally polarized signal, wherein an impedance value Z1 of the first element is substantially greater (open switch-infinity) than an impedance value Z2 of the second element so that a horizontally polarized signal having a zero degree phase shift is radiated by the antenna.

FIG. 2F illustrates a schematic side view of an exemplary dual polarization switchable patch antenna, wherein an impedance value Z1 of element 230 is substantially greater (open switch-infinity) than an impedance value Z2 of element 232 at terminal 224F. In this way, a waveform for the horizontally polarized signal is provided with a phase shift of zero degrees (216*a*, 216*b*) as it is radiated by the antenna because of the large disparity in the impedance values.

Figure 2G:
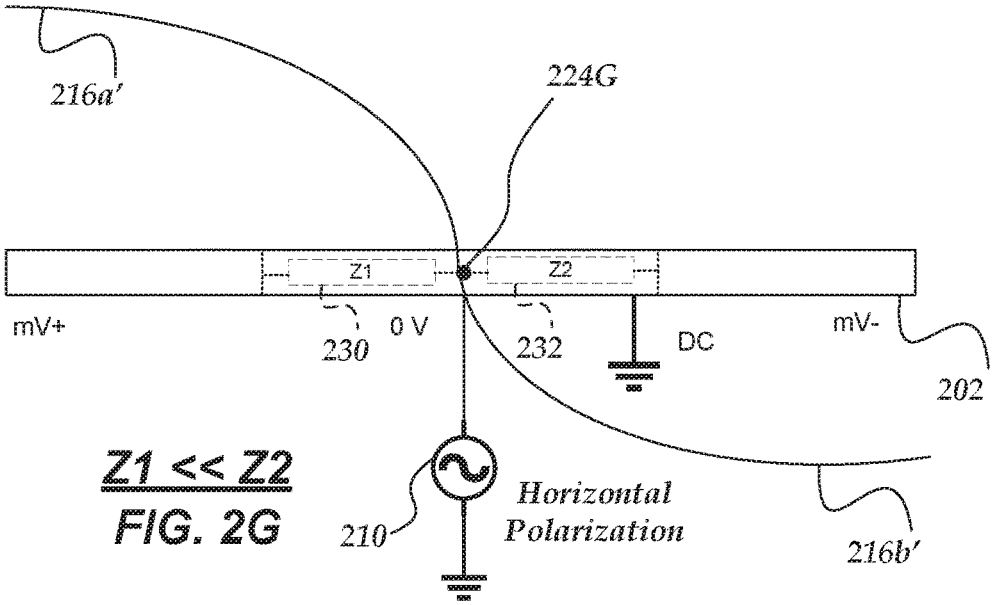
FIG. 2G shows a schematic side view of an exemplary switchable dual polarization patch antenna having selectable phase shift direction for the horizontally polarized signal, wherein an impedance value Z2 of the first element is substantially greater (open switch-infinity) than an impedance value Z1 of the second element so that a horizontally polarized signal having a phase shift of 180 degrees is radiated by the antenna.

FIG. 2G shows a schematic side view of an exemplary switchable dual polarization patch antenna, wherein an impedance value Z2 of element 230 is substantially greater (open switch-infinity) than an impedance value Z1 of the element 232. In this way, a waveform for the horizontally polarized signal is provided with a phase shift of 180 degrees (216*a*', 216*b*') as it is radiated by the antenna because of the large disparity in the impedance values.

Generalized Operations

Figure 3:
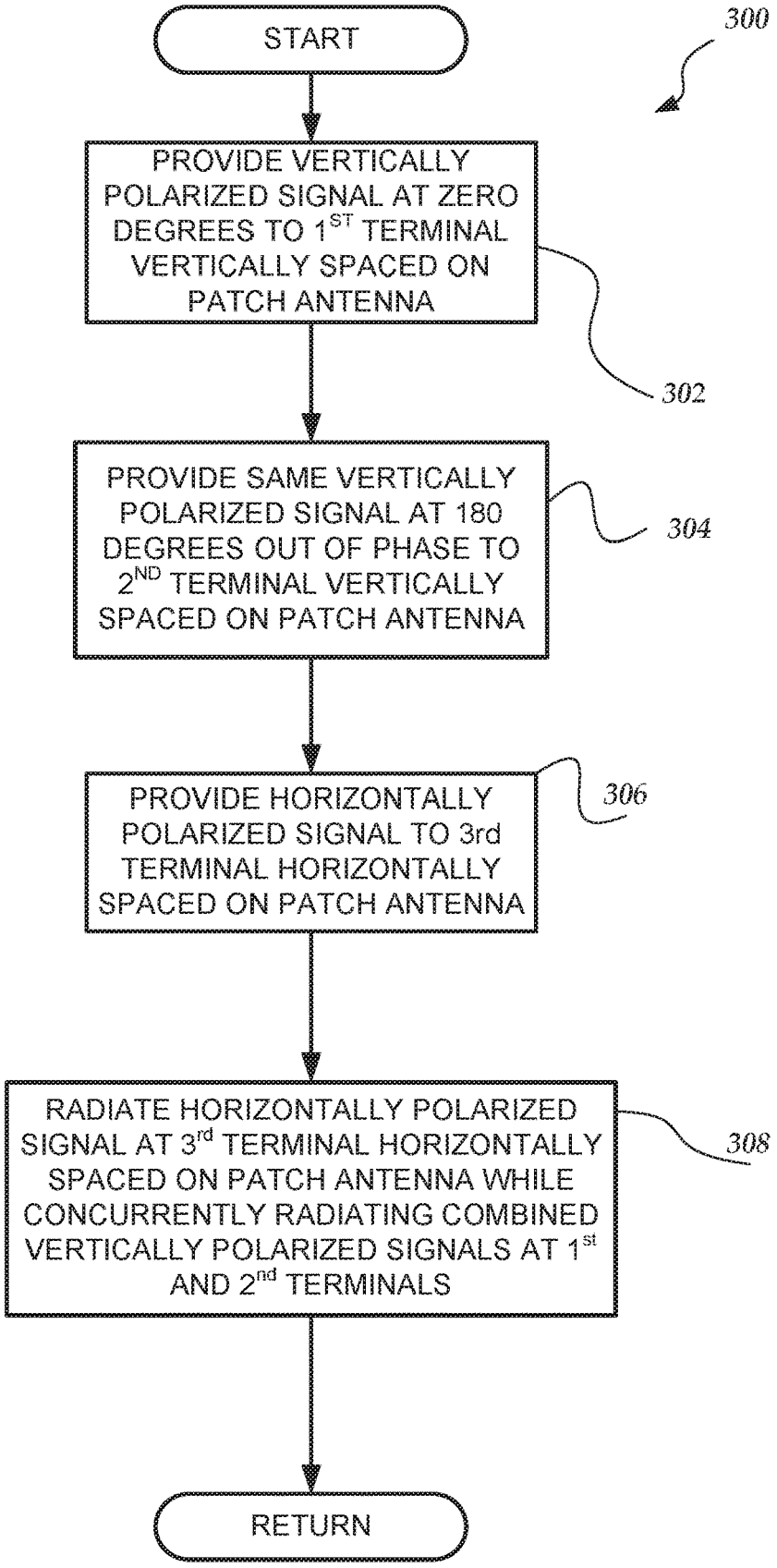
FIG. 3 shows a flow chart illustrating the operation of a dual polarization patch antenna that provides for concurrent radiation of horizontally and vertically polarized signals with improved cross polarization isolation.

FIG. 3 shows a flow chart illustrating the operation of a dual polarization patch antenna that concurrently radiates horizontal and vertical polarized signals with improved cross polarization isolation. Moving from a start block to block 302, a component of a vertically polarized signal with zero degrees of phase shift is provided to a first terminal. At a block 304, another component of the same vertically polarized signal with 180 degrees of phase shift is provided to a second terminal. Stepping to block 306, a horizontally polarized signal with is provided to a third terminal. Flowing to block 308, the horizontally polarized signal and the two components of the vertically polarized signal having a phase shift difference of 180 degrees are concurrently radiated by the dual polarization patch antenna with improved cross polarization isolation. Next, the process returns to performing other actions.

Figure 4A:
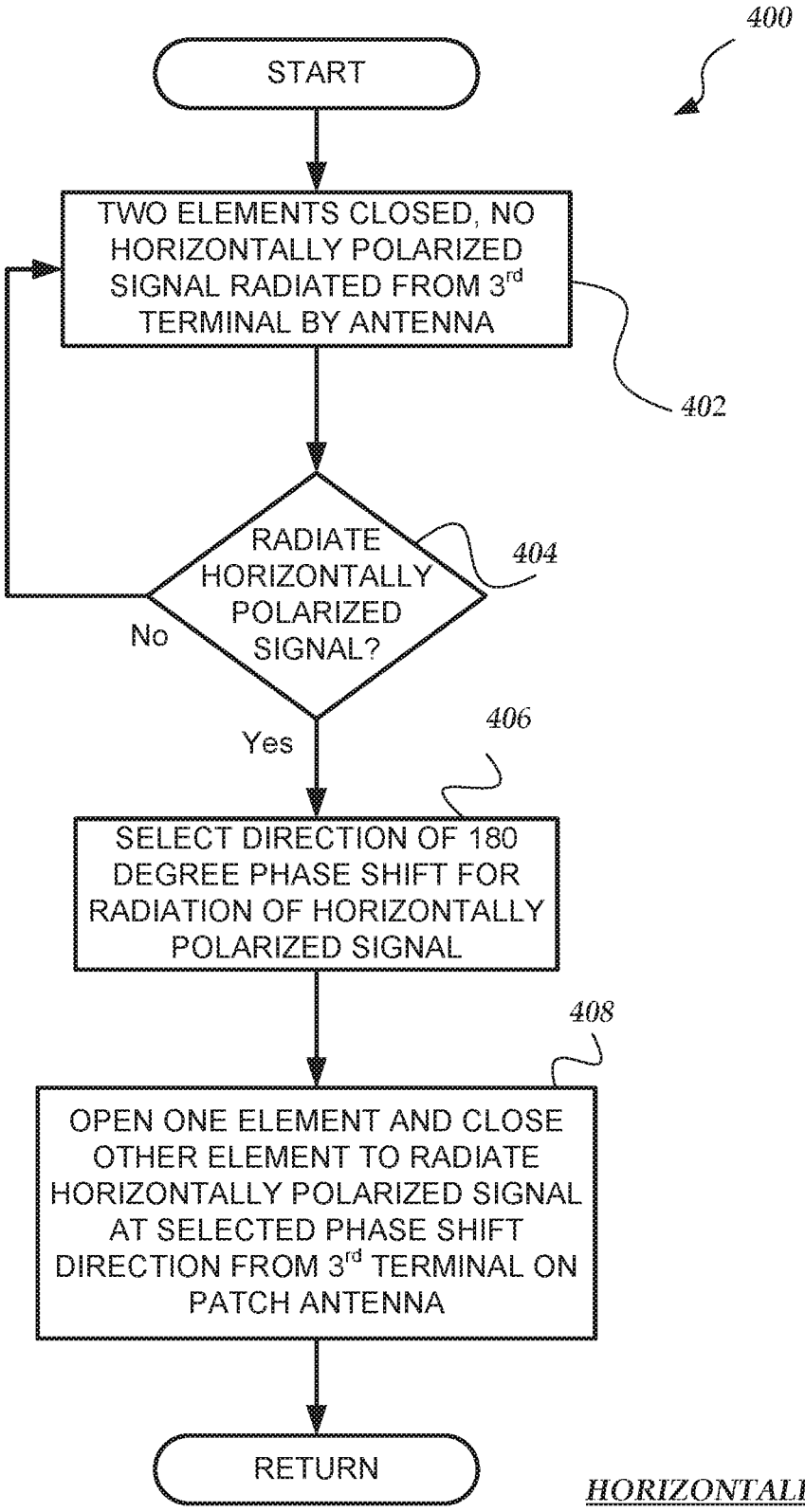
FIG. 4A illustrates a flow chart showing the operation of a dual polarization patch antenna having switchable elements for selecting a phase shift for horizontally polarized signals to improve cross polarization isolation during concurrent radiation of vertically polarized and horizontally polarized signals.

FIG. 4A illustrates flow chart 400 showing the operation of a dual polarization patch antenna having switchable elements for selecting a phase shift for a horizontally polarized signal to improve cross polarization isolation during concurrent radiation of vertically polarized and horizontally polarized signals. Moving from a start block, the process advances to block 402 where two impedance elements having substantially the same impedance are coupled to a terminal in an aperture at a center of a planar conductor. Although the terminal is coupled to a horizontally polarized sinusoidal signal source, the horizontally polarized signal does not radiate from the terminal because of the relative equivalency of the impedance values of the two elements. Moving to decision block 404, a determination is made as to whether to select one of the elements to exhibit a substantially greater impedance than the other element, e.g., one of the elements is a switch which is opened. When the determination is affirmative, the process flows to block 406 where a direction of 180 degrees of phase shift for the horizontally polarized signal is selected by choosing which of the two elements will provide substantially greater impedance than the other element. At block 408, the selected element provides the substantially greater impedance, and the horizontally polarized signal is radiated in a chosen direction with 180 degrees of phase shift. Next, the process returns to performing other actions.

Figure 4B:
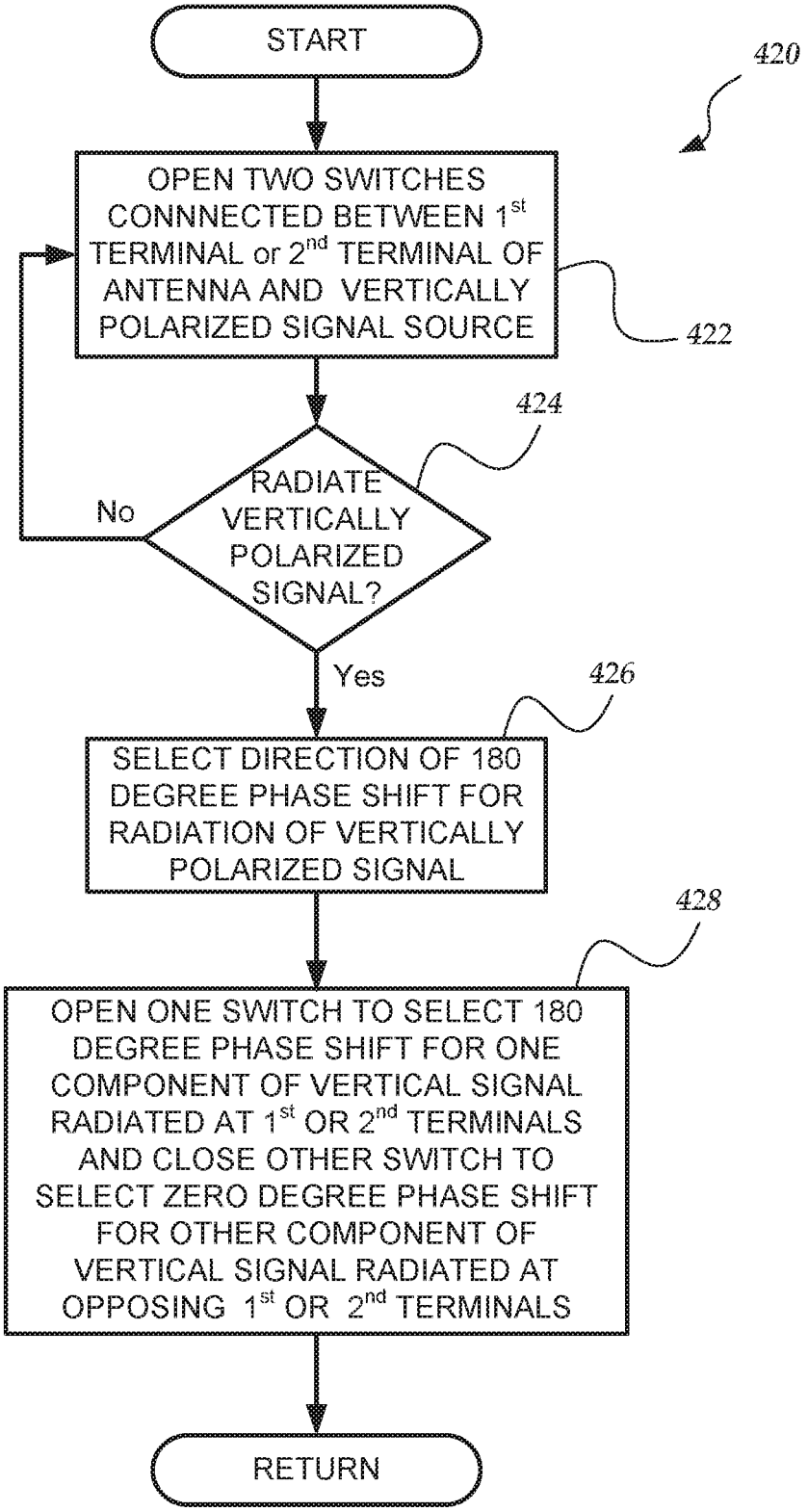
FIG. 4B shows a flow chart illustrating the operation of a dual polarization patch antenna having switchable elements for selecting a phase shift for the radiation of vertically polarized signals to improve cross polarization isolation during concurrent radiation of vertically polarized and horizontally polarized signals.

FIG. 4B shows flow chart 420 illustrating the operation of a dual polarization patch antenna having switchable elements for selecting a phase shift for the radiation of two components of vertically polarized signals to improve cross polarization isolation during concurrent radiation of vertically polarized signals and horizontally polarized signals. Moving from a start block, the process advances to block 422 where two switches connected in parallel to a vertically polarized sinusoidal signal source and a hybrid coupler are selectively opened to prevent coupling of the vertically polarized signal to either of two terminals on a planar surface of the antenna. Moving to decision block 424, a determination is made as to whether to selectively close one of the two switches to enable radiation of the vertically polarized signal. When the determination is affirmative, the process flows to block 426 where a direction of 180 degrees of phase shift for the vertically polarized signal is selected by choosing which of the two switches to close. At block 428, the selected switch is closed, and one component of the vertically polarized signal is coupled to the hybrid coupler which provides the component with 180 degrees of phase shift as it is radiated at one terminal. Further, another component of the vertically polarized signal is provided with zero degrees of phase shift as it is radiated at another terminal. Next, the process returns to performing other actions.

Figure 5:
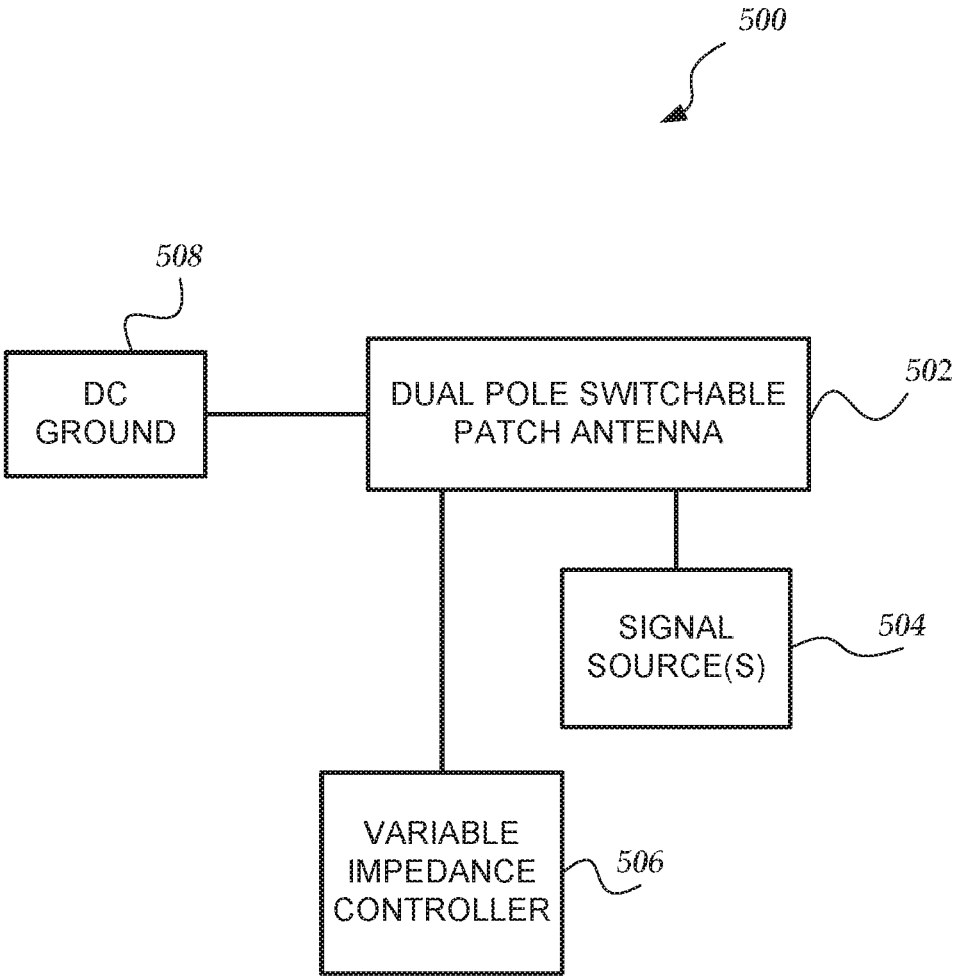
FIG. 5 shows a schematic of an apparatus for controlling the concurrent radiation of horizontally and vertically polarized signals by a dual polarization patch antenna to improve cross polarization isolation in accordance with the one or more embodiments of the invention.

FIG. 5 shows a schematic of an apparatus for controlling the concurrent radiation of horizontally and vertically polarized signals by a dual polarization patch antenna having improved cross polarization isolation in accordance with the one or more embodiments of the invention.

FIG. 5 shows a schematic illustration of an exemplary apparatus 500 that is employed to operate switchable dual polarization patch antenna 502. Variable impedance controller 506 is employed to control a conductive and non-conductive state of a switched component included with switchable patch antenna 502 (not shown) that disables or enables concurrent radiation of a vertically polarized and horizontally polarized signals by the antenna. The vertically polarized and horizontally polarized signals may be provided by one or more of signal source 504. Also, DC ground 508 is coupled to switchable patch antenna 502.

It will be understood that each block of the flowchart illustrations, and combinations of blocks in the flowchart illustrations, (or actions explained above with regard to one or more systems or combinations of systems) can be implemented by computer program instructions. These program instructions may be provided to a processor to produce a machine, such that the instructions, which execute on the processor, create means for implementing the actions specified in the flowchart block or blocks. The computer program instructions may be executed by a processor to cause a series of operational steps to be performed by the processor to produce a computer-implemented process such that the instructions, which execute on the processor to provide steps for implementing the actions specified in the flowchart block or blocks. The computer program instructions may also cause at least some of the operational steps shown in the blocks of the flowcharts to be performed in parallel. Moreover, some of the steps may also be performed across more than one processor, such as might arise in a multi-processor computer system. In addition, one or more blocks or combinations of blocks in the flowchart illustration may also be performed concurrently with other blocks or combinations of blocks, or even in a different sequence than illustrated without departing from the scope or spirit of the invention.

Additionally, in one or more steps or blocks, may be implemented using embedded logic hardware, such as, an Application Specific Integrated Circuit (ASIC), Field Programmable Gate Array (FPGA), Programmable Array Logic (PAL), or the like, or combination thereof, instead of a computer program. The embedded logic hardware may directly execute embedded logic to perform actions some or all of the actions in the one or more steps or blocks. Also, in one or more embodiments (not shown in the figures), some or all of the actions of one or more of the steps or blocks may be performed by a hardware microcontroller instead of a CPU. In one or more embodiment, the microcontroller may directly execute its own embedded logic to perform actions and access its own internal memory and its own external Input and Output Interfaces (e.g., hardware pins and/or wireless transceivers) to perform actions, such as System On a Chip (SOC), or the like.

The above specification, examples, and data provide a complete description of the manufacture and use of the invention. Since many embodiments of the invention can be made without departing from the spirit and scope of the invention, the invention resides in the claims hereinafter appended.

What is claimed as new and desired to be protected by Letters Patent of the United States is:

1. An apparatus for controlling radiation of signals, comprising:

an antenna including:

a first terminal and a second terminal included in a first portion of a planar conductor, wherein a third terminal is included in a second portion of the planar conductor;

a first component of a vertically polarized signal is provided to the first terminal and a second component of the vertically polarized signal is provided to the second terminal, and wherein a phase inversion is provided between the first component and the second component of the vertically polarized signal; and a horizontally polarized signal is provided to the third terminal, wherein the phase inversion provides cross polarization isolation during concurrent radiation of the vertically polarized signal and the horizontally polarized signal by the antenna.

2. The apparatus of claim 1, wherein the first and the second terminals in the first portion of the planar conductor, further comprises vertically spacing the first terminal and the second terminal at separate locations in the first portion of the planar conductor.

3. The apparatus of claim 1, wherein the third terminal in the second portion of the planar conductor, further comprises horizontally spacing the third terminal at a location in the second portion of the planar conductor.

4. The apparatus of claim 1, further comprising:

a hybrid coupler that provides the phase inversion between the first component and the second component of the vertically polarized signal, wherein the hybrid coupler is coupled between the vertically polarized signal and one of the first terminal or the second terminal.

5. The apparatus of claim 1, further comprising:

a first switch coupled between the first terminal and a first signal source that provides the vertically polarized signal, and a second switch coupled between the second terminal and the first signal source;

a hybrid coupler that is coupled in parallel between the first switch and the second switch, wherein the hybrid coupler provides the phase inversion between the first component and the second component of the vertically polarized signal; and in response to one of the first switch or the second switch being in an open state and one of the other of the first switch or the second switch being in a closed state, providing the phase inversion between the first component and the second component of the vertically polarized signal.

6. The apparatus of claim 1, further comprising:

one or more signal sources that are arranged to provide one or more of the horizontally polarized signal or the vertically polarized signal at one or more frequencies including one or more of a radio signal frequency or a microwave signal frequency.

7. The apparatus of claim 1, further comprising:

a direct current (DC) ground that is coupled to the planar conductor, wherein the DC ground improves impedance match and radiation patterns and provides at least a portion of a bias current for one or more elements of the antenna.

8. The apparatus of claim 1, wherein the apparatus further comprises:

a holographic metasurface antenna (HMA) that includes a plurality of the antennas arranged to radiate a plurality of vertically polarized signals and horizontally polarized signals in a beam waveform.

9. The apparatus of claim 1, further comprising:

an aperture in the second portion that is positioned at a center of the planar conductor, wherein the third terminal is positioned within the aperture at the center of the planar conductor;

a first element that is coupled between the third terminal and an edge of the planar conductor abutting the aperture;

a second element that is coupled between the third terminal and an opposite edge of the planar conductor abutting the aperture;

wherein the horizontally polarized signal is radiated by the antenna based on one of a first impedance value of the first element or a second impedance value of the second element being greater than each other; and wherein the horizontally polarized signal is non-radiated by the antenna based on the first impedance value of the first element being equal to the second impedance value of the second element.

10. The apparatus of claim 9, further comprising:

wherein each of the first element and the second element is arranged to further comprise one of a switch, an electronic switch, a varactor, a fixed impedance device, or a variable impedance device; and wherein the aperture further comprises a two-dimensional shape that is one of rectangular, square, triangular, circular, curved, elliptical, quadrilateral, or polygon.

11. A method for controlling radiation of signals by an antenna, comprising:

providing a first terminal and a second terminal included in a first portion of a planar conductor, wherein a third terminal is included in a second portion of the planar conductor;

providing a first component of a vertically polarized signal to the first terminal and a second component of the vertically polarized signal to the second terminal, and wherein a phase inversion is provided between the first component and the second component of the vertically polarized signal; and providing a horizontally polarized signal to the third terminal, wherein the phase inversion of phase shift provides cross polarization isolation during concurrent radiation of the vertically polarized signal and the horizontally polarized signal by the antenna.

12. The method of claim 11, wherein the first and the second terminals in the first portion of the planar conductor, further comprises vertically spacing the first terminal and the second terminal at separate locations in the first portion of the planar conductor.

13. The method of claim 11, wherein the third terminal in the second portion of the planar conductor, further comprises horizontally spacing the third terminal at a location in the second portion of the planar conductor.

14. The method of claim 11, further comprising:

a hybrid coupler that provides the polarity inversion between the first component and the second component of the vertically polarized signal, wherein the hybrid coupler is coupled between the vertically polarized signal and one of the first terminal or the second terminal.

15. The method of claim 11, further comprising:

providing a first switch that is coupled between the first terminal and a first signal source for the vertically polarized signal, and a second switch that is coupled between the second terminal and the first signal source;

providing a hybrid coupler that is coupled in parallel between the first switch and the second switch, wherein the hybrid coupler provides the phase inversion between the first component and the second component of the vertically polarized signal; and in response to one of the first switch or the second switch being in an open state and one of the other of the first switch or the second switch being in a closed state, providing the phase inversion between the first component and the second component of the vertically polarized signal.

16. The method of claim 11, wherein the apparatus further comprises:

employing a holographic metasurface antenna (HMA) that includes a plurality of the antennas arranged to radiate a plurality of vertically polarized signals and horizontally polarized signals in a beam waveform.

17. The method of claim 11, further comprising:

providing one or more signal sources that are arranged to provide one or more of the horizontally polarized signal or the vertically polarized signal at one or more frequencies including one or more of a radio signal frequency or a microwave signal frequency; and providing a direct current (DC) ground that is coupled to the planar conductor, wherein the DC ground improves impedance match and radiation patterns and provides at least a portion of a bias current for one or more elements of the antenna.

18. The method of claim 11, further comprising:

providing an aperture in the second portion that is positioned at a center of the planar conductor, wherein the third terminal is positioned within the aperture at the center of the planar conductor;

providing a first element that is coupled between the third terminal and an edge of the planar conductor abutting the aperture;

providing a second element that is coupled between the third terminal and an opposite edge of the planar conductor abutting the aperture;

wherein the horizontally polarized signal is radiated by the antenna based on a first impedance value of the first element or a second impedance value of the second element being greater than each other; and wherein the horizontally polarized signal is non-radiated by the antenna based on the first impedance value of the first element being equal to the second impedance value of the second element.

19. The method of claim 18, further comprising:

wherein each of the first element and the second element is arranged to further comprise one of a switch, an electronic switch, a varactor, a fixed impedance device, or a variable impedance device; and wherein the aperture further comprises a two-dimensional shape that is one of rectangular, square, triangular, circular, curved, elliptical, quadrilateral, or polygon.

20. A non-transitory computer readable media that stores instructions for controlling radiation of signals by an antenna, wherein execution of the instructions by one or more processors performs actions, comprising:

providing a first terminal and a second terminal that is included in a first portion of a planar conductor, wherein a third terminal is included in a second portion of the planar conductor;

providing a first component of a vertically polarized signal to the first terminal and a second component of the vertically polarized signal to the second terminal, and wherein a phase inversion is provided between the first component and the second component of the vertically polarized signal; and providing a horizontally polarized signal to the third terminal, wherein the phase inversion provides cross polarization isolation during concurrent radiation of the vertically polarized signal and the horizontally polarized signal by the antenna.

* * * * *